US005090445A

United States Patent [19]

Jackson

[11] Patent Number: 5,090,445

[45] Date of Patent: Feb. 25, 1992

[54] AIR ACTUATED DAMPER

[76] Inventor: Bert W. Jackson, 1219 Garfield Rd., Lansing, Mich. 48917

[21] Appl. No.: 656,449

[22] Filed: Feb. 19, 1991

[51] Int. Cl.[5] ..... F16K 15/03

[52] U.S. Cl. ..... 137/527.8

[58] Field of Search ..... 137/527.4, 527.6, 527.8

[56] References Cited

U.S. PATENT DOCUMENTS

| | | | |
|---|---|---|---|
| 2,840,317 | 6/1958 | Kozak | 137/527.8 X |
| 3,941,151 | 3/1976 | Biddle | 137/527.8 X |
| 4,174,913 | 11/1979 | Schliesser | 137/527.8 |
| 4,262,608 | 4/1981 | Jackson | 110/162 |

FOREIGN PATENT DOCUMENTS

| | | | |
|---|---|---|---|
| 1241221 | 7/1971 | United Kingdom | 137/527.6 |

*Primary Examiner*—Robert G. Nilson
*Attorney, Agent, or Firm*—Ian C. McLeod

[57] ABSTRACT

An improved air actuated damper device (10, 30) is described. The damper comprises a cylindrical conduit (11, 31) that can be joined to a flue pipe (17) at a proximal end (**11*b*, 31*b*) of the damper device; a damper support beam (13, 33) across the conduit offset above a longitudinal axis (a-a, c-c) of the conduit; and a damper blade (15, 35) that pivots on a pivot axis (b-b, e-e). The damper blade is comprised of an upper section (15*a*, 35*a*) and a lower section (15*b*, 35*b*) so that the damper blade pivots on the pivot axis and opens when gas flows through the conduit and closes to seal against sealing lips (11*e*, 31*e*) and 11*f*, 31*f***) extending from and into the conduit when there is no gas flow. The device provides reliable dampering for the flue gas exhaust of a furnace.

27 Claims, 3 Drawing Sheets

Figure 1:
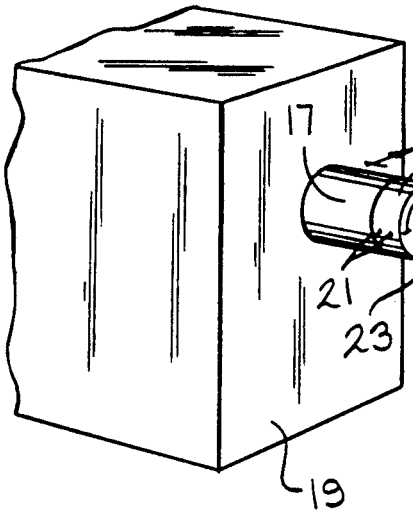

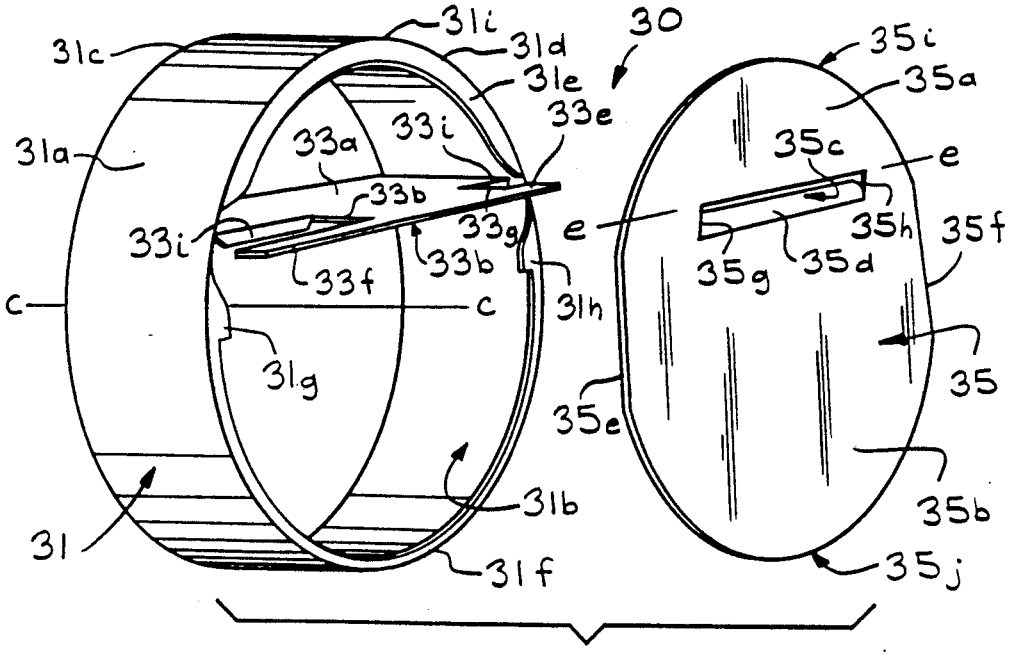
FIG. 7
FIG. 8
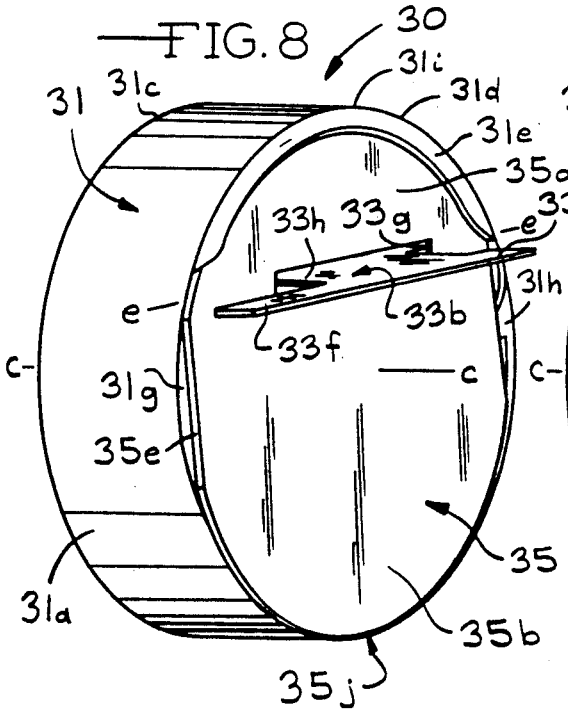
FIG. 9
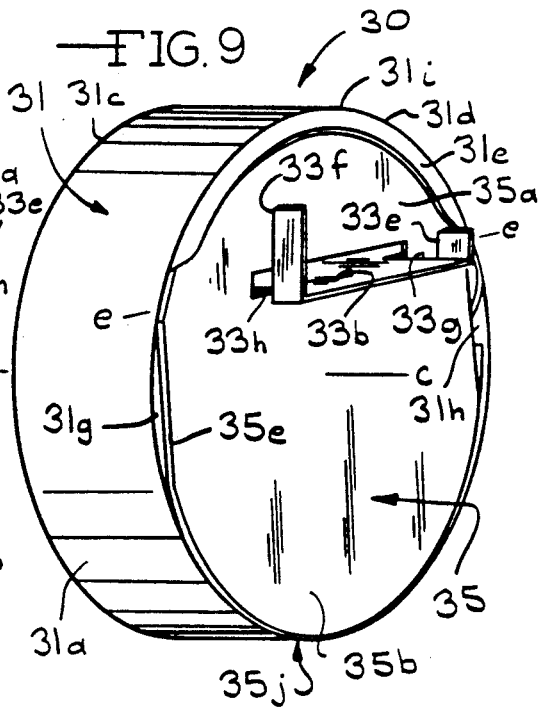

AIR ACTUATED DAMPER

BACKGROUND OF THE INVENTION (1) Field of the Invention

The present invention relates to an air actuated damper that is particularly adapted for use in a furnace. In particular, the present invention relates to an air actuated damper that pivots on a cross beam mounted in the conduit. This allows the damper to swing open when air and exhaust gases are flowing out through the conduit. Likewise, when the airflow through the conduit stops, gravity causes the damper to automatically pivot on the cross beam, closing off the conduit.

(2) Prior Art

The prior art has described various types of dampers. Most of the prior art dampers have a damper blade pivotably mounted on a pivot rod or axle mounted across a flue conduit. One type of pivot rod pivots at its opposed ends which are mounted in recepticles mounted on the inside wall of the conduit. The opposed ends of the pivot rod can also extend through the conduit and have two enlarged portions at the opposed ends that retain the pivot rod across the conduit. Both of the above pivot rods have the damper blade secured to the pivot rod.

Another type of pivot rod, constructed similarly to the above described pivot rods, instead has the pivot rod secured to the conduit with the damper blade pivoting on the pivot rod. In this construction, the pivot rod is pivotably disposed through U-bolts or straps provided on the face of the damper blade. The pivot rod can also be threaded through alternating inward and outward straps forged into the damper blade. Illustrative of the latter prior art dampers is Jackson U.S. Pat. No. 4,262,608.

The problem with the prior art dampers is that they are susceptible to malfunctioning and breakdown caused by a build-up of flue particulate and ash at the point where the damper blade pivots on the pivot rod or where the pivot rod pivots on the conduit wall. Eventually, the build-up becomes so damaging that the damper blade ceases to pivot and becomes stuck in a partially opened or closed position.

OBJECTS

It is therefore an object of the present invention to provide a gravity actuated damper that eliminates need for a pivot rod and that instead pivots on a pivot beam extending through a pivot slot in a damper blade. Further, it is an object of the present invention to provide a preferred damper that automatically adjusts the size of the conduit aperture relative to the volume of gas flowing through the conduit. Further; it is an object of the present invention to provide a damper where the control of the damper aperture is entirely contained within the confines of the sidewall of the conduit. Still further, it is an object of the present invention to provide a unique air actuated damper that is simple and inexpensive to construct and of a construction that will not cause flue particulate and ash to build-up on the pivot axis, thereby eliminating the problem of the damper blade becoming jammed or wedged in the conduit after continuous use. These and other objects will become increasingly apparent to those skilled in the art by reference to the following descriptions and to the drawings.

IN THE DRAWINGS

FIG. 1 shows one embodiment of the present invention and is a left side perspective view of an air actuated damper device 10 mounted on a flue pipe 17 extending from a furnace firebox 19 and particularly showing a conduit 11 supporting a damper support beam 13 and a damper blade 15 connected to a chimney 23.

Figure 2:
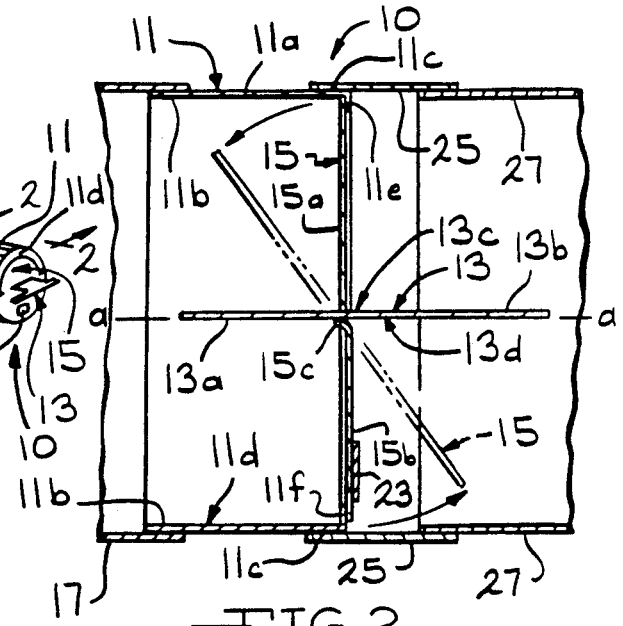

FIG. 2 is a front cross-sectional view along line 2—2 of FIG. 1 showing the damper blade 15 pivotably mounted on the damper support beam 13 in conduit 11 and extension conduit 25 and chimney 27.

Figure 3:
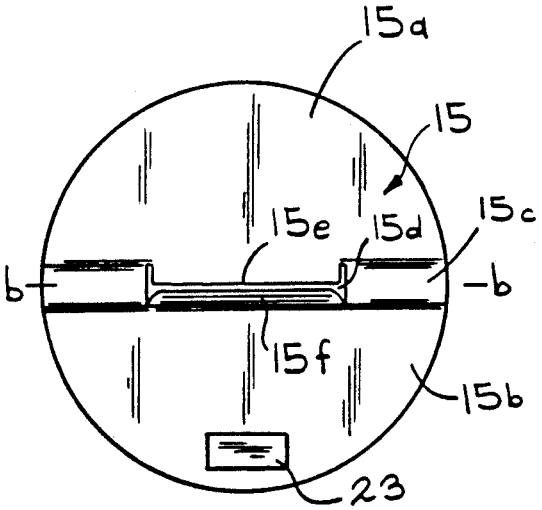

FIG. 3 is a plan view of the damper blade 15 particularly showing sealing tabs **15*e* and 15*f* and the pivot axis b—b through a receiving slot 15*d* for the damper blade 15**.

Figure 4:
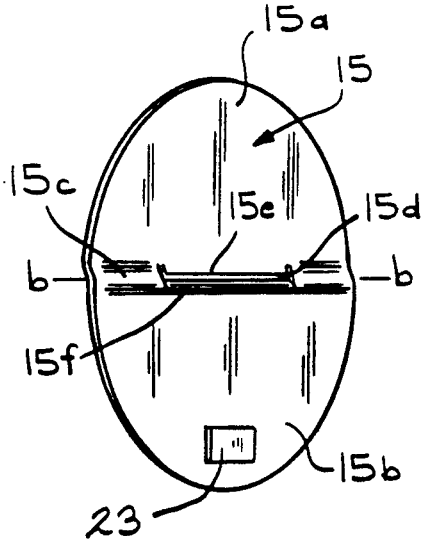

FIG. 4 is a left side perspective view of the damper blade 15 particularly showing an upper section **15*a* and a lower section 15*b* joined by a diagonal section 15*c*** along the pivot axis b—b.

Figure 5:
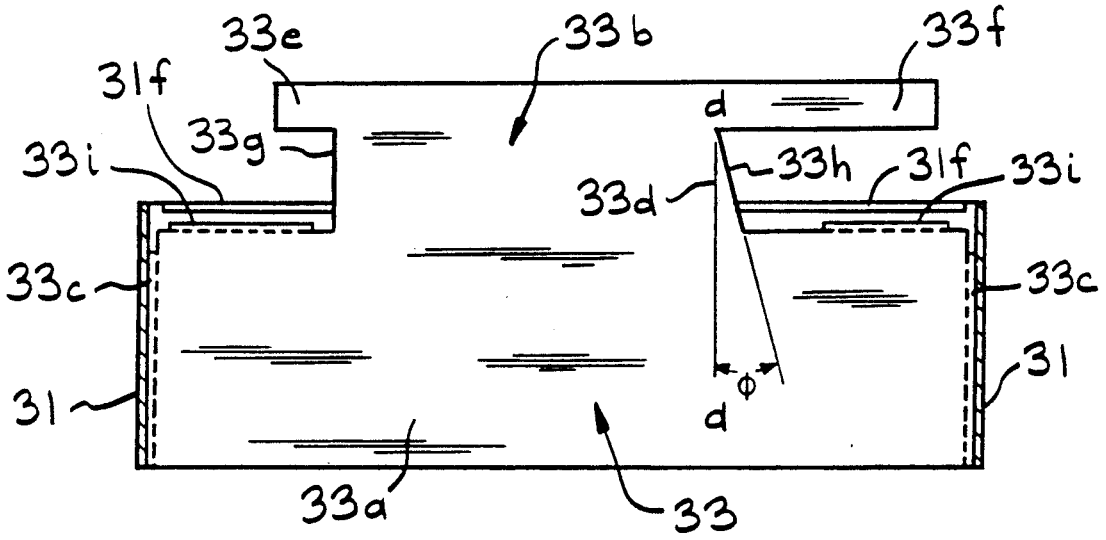

FIG. 5 shows another preferred embodiment of the present invention and is a cross-sectional plan view of a damper support beam 33 having a T-shaped extension beam section **33*b* and mounted in a conduit 31**.

Figure 6:
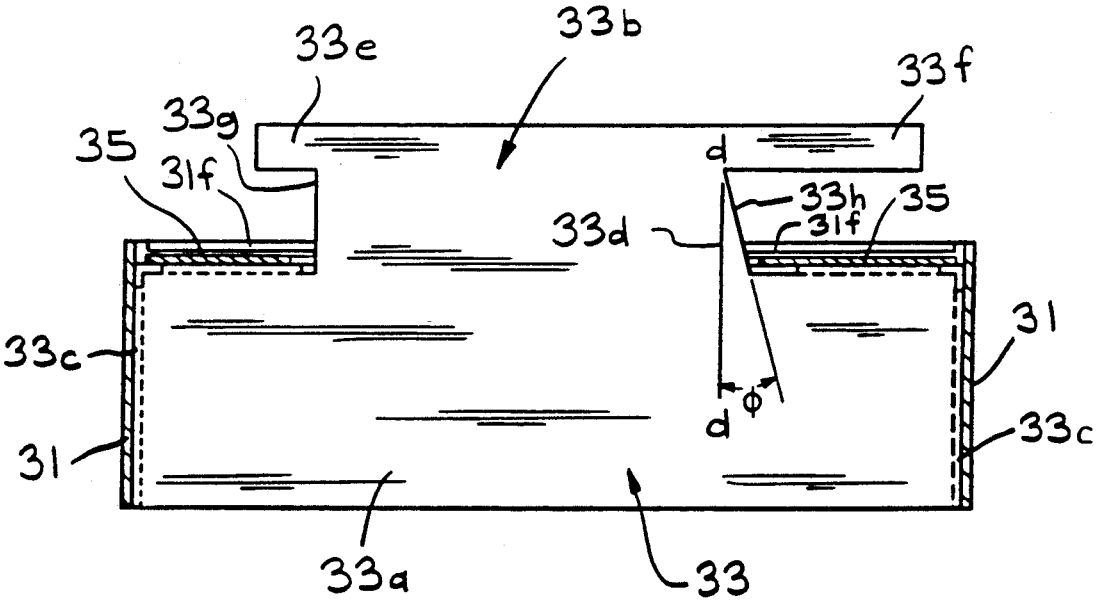

FIG. 6 is a cross-sectional plan view of the damper support beam 33 mounted in the conduit 31 and having a pivotable damper blade 35 mounted on the T-shaped extension beam section **33*b***.

FIG. 7 is a separated perspective view showing the damper support beam 33 mounted in the conduit 31 offset above the axis c—c and the damper blade 35.

FIG. 8 is a left side perspective view of the damper blade 35 mounted on the T-shaped extension beam section **33*b* of the damper support beam 33 and closing off the conduit 31**.

FIG. 9 is a left side perspective view of the damper blade 35 mounted on the T-shaped extension beam **33*b* and secured in the conduit 31 by a left tab 33*e* and a right tab 33*f*** of the T-shaped extension beam.

GENERAL DESCRIPTION

The present invention relates to an air actuated damper device which comprises: a conduit means through which a gas is to be conveyed along a path in the conduit means around a longitudinal axis; a support beam means with opposed sides and a thin cross-section mounted across the conduit means in the path of the gas, wherein the opposed sides of the support beam means define a plane which is in the path of the gas such that the gas flows along the sides of the support beam means; and a damper means pivotably mounted across the path of the conveyed gas on the support beam means in a slot in the damper means, wherein the damper means is closed when gas is not conveyed in the conduit means and opens by pivoting on the support beam means when a gas is conveyed in the conduit means.

The damper device is generally constructed of stainless steel. Other materials can be used where appropriate.

SPECIFIC DESCRIPTION

FIGS. 1 to 4 show an air actuated damper device 10 of the present invention which is comprised of a conduit 11, a damper support beam 13 and a damper blade 15. As shown in FIGS. 1 and 2, the conduit 11 is circular in cross-section along the axis a—a with a cylindrical outer wall **11*a* between opposed proximal and distal ends 11*b* and 11*c*, respectively. The proximal end 11*b* of conduit 11 is slightly smaller in diameter than a flue pipe 17 extending from a furnace firebox 19 so that the conduit 11 can be secured to the flue pipe 17 by rivets or ring clamps (not shown) or other suitable fastening means. Although the conduit 11 is shown as a cylindrical member, it should be understood that the conduit 11** could have any shape as long as it has an enclosed sidewall between opposed ends for conveying a gas.

The damper support beam 13 comprises a relatively thin cross beam section 13*a* and a T-shaped extension beam section 13*b*. The cross beam section 13*a* extends across the conduit 11 and is secured to opposite sides of an inner surface 11*d* adjacent to the distal end 11*c* of conduit 11, slightly offset above the axis a-a by rivets 21 (FIG. 1) or other suitable fastening means such as welding. The extension beam section 13*b* extends from the cross beam section 13*a* away from the distal end 11*c* of the conduit 11 and provides for pivoting of the damper blade 15.

As shown in FIG. 3 and 4, the damper blade 15 is bisected into an upper section 15*a* and a lower section 15*b* by a diagonal section 15*c* (FIG. 4). The upper and lower sections 15*a* and 15*b* are in parallel planes on opposite sides of the pivot axis b—b. The axis b—b bisects the diagonal section 15*c* along a pivot slot 15*d*. The pivot slot 15*d* is positioned on the extension beam section 13*b* extending from the cross beam section 13*a* so that when the conduit 11 is closed, an upper sealing tab 15*e* depending from the upper section 15*a* and a lower sealing tab 15*f* extending from the lower section 15*b* of the damper blade 15 rest against an upper surface 13*c* and a lower surface 13*d*, respectively, (FIG. 1) of the extension beam section 13*b* of the damper support beam 13.

The distal end 11*c* of conduit 11 has semicircular sealing lips 11*e* and 11*f* (FIG. 2). When the gas is not being conveyed through the conduit 11 and the damper blade 15 is perpendicular to the axis a—a in the closed position, the upper section 15*a* of blade 15 is inside of the top lip 11*e* and the lower section 15*b* is outside of the bottom lip 11*f*. Since the cross beam section 13*a* is secured to the cylindrical inner surface 11*b* slightly offset above the pivot axis b—b, the lower section 15*b* of the damper blade 15 is heavier than the upper section 15*a*. In this manner, gravity can act on the damper blade 15 to close the conduit 11 when gas is not conveyed in the conduit 11. An optional plate 23 secured to the bottom section 15*b* of blade 15 adds weight to the lower section 15*b* and can adjust the conduit aperture when gas is conveyed through the conduit 11.

An extension conduit 25 which is slightly larger in cross-section area along the axis a—a, is provided at the distal end 11*c* of the conduit 11. A chimney pipe 27 is mounted on the extension conduit 25 spaced from the conduit 11 for conveying the gas away from the furnace firebox 19.

FIGS. 5 to 9 show another embodiment of the air actuated damper device 30 of the present invention which comprises a conduit 31, a damper support beam 33 and a damper blade 35. The conduit 31 is circular in cross-section along the axis c—c with a cylindrical outer wall 31*a* and an inner surface 31*b* between opposed proximal and distal ends 31*c* and 31*d*, respectively. The proximal end 31*c* of conduit 31 is secured to a flue pipe (not shown) of a furnace firebox (not shown) by rivets or ring clamps (not shown) or other suitable fastening means in a similar manner to the conduit 11 shown in FIGS. 1 and 2. An upper sealing lip 31*e* and a lower sealing lip 31*f* extend between opposed sealing tabs 31*g* and 31*h*.

As shown in FIGS. 7 to 9, the damper support beam 33 comprises a relatively thin cross beam section 33*a* and a T-shaped extension beam section 33*b*. The cross beam section 33*a* extends across the conduit 31 and is secured to the inner surface 31*b* of the conduit 31, offset approximately one half the distance between the axis c—c and an upper apex 31*i* of the conduit 31, by securing tabs 33*c* that are welded or riveted (not shown) or secured to the conduit 31 by any suitable fastening means. The extension beam section 33*b* extends from the cross beam section 33*a* away from the distal end 31*c* of the conduit 31 and provides for pivoting of the damper blade 35.

The T-shaped extension beam section 33*b* comprises a base portion 33*d* extending to a left tab 33*e* and a right tab 33*f*. A first side 33*g* of the base portion 33*d* adjacent to the left tab 33*e* is parallel to the axis c—c while a second side 33*h* of the base portion 33*d* adjacent to the right tab 33*f* tapers outwardly away from the cross beam section 33*a* and inwardly towards the axis c—c at an angle of between about 45 and 85 degrees as measured from a line d—d parallel to the c—c axis and extending from the junction of the right tab 33*f* and the second side 33*h* of the base portion 33*d* towards the cross beam section 33*a*.

As shown in FIG. 7, the damper blade 35 is divided into an upper section 35*a* and a lower section 35*b* by a pivot slot 35*c* having a sealing tab 35*d*. The damper blade 35 is essentially circular in plan view with two parallel straight sides 35*e* and 35*f* extending part of the length of the lower section 35*b*, beginning just below the pivot axis e—e through the pivot slot 35*c*.

The damper blade 35 is mounted on the damper support beam 33 by first positioning a first side 35*g* of the pivot slot 35*c* over the right tab 33*f* and then moving the damper blade 35 toward the conduit 31 so that the first side 35*g* of the 35*c* contacts the junction of the second side 33*h* of the base portion 33*c* and the right tab 33*f*. A second side 35*h* of the pivot slot 35*c* is then moved over the left tab 33*e* of the extension beam section 33*b* and the damper blade 35 is slid along the base portion 33*d* toward the conduit 31 until an upper end 35*i* of the upper section 35*a* of the damper blade 35 is inside of the upper sealing lip 31*e* and a lower end 35*j* of the lower section 35*b* is outside of the lower sealing lip 31*f* with the sides 35*e* and 35*f* sealing against the sealing tabs 31*g* and 31*h*, respectively. The left tab 33*e* and the right tab 33*f* are then bent upward (FIG. 9) at about an angle of between 70 to 90 degrees to the plane of the damper support beam 33 to lock the damper blade 35 in place. The damper blade 15, FIGS. 1 to 4, is mounted on the extension beam section 13*b* of the damper support beam 13 in a similar process.

With no gas flow through the conduit 31, the damper blade 35 closes off 98% of the distal end 31*d* of the conduit 31 with the sealing tab 35*d* sealing against the base portion 33*d* of the damper support beam 33 and the sealing lips 31*e* and 31*f* and the sealing tabs 31*g* and 31*h* sealing against the damper blade 35. Depending stop tabs 33*i* are provided on the cross beam section 33*a* adjacent to the first and second sides 33*g* and 33*h* of the base portions 33*d* and help to guide the damper blade 35 to the proper closed position in the conduit 31 when there is no gas flow through the conduit 31.

IN OPERATION

In the embodiment shown in FIGS. 1 to 4 with no gas flow through the flue pipe 17 and into the conduit 11 from the furnace firebox 19, the damper blade 15 closes off the distal end 11*c* of the conduit 11. When there is gas flow, however, more gas will flow below the cross beam section 13*a* because the cross-sectional area of the conduit 11 is greater below the cross beam section 13*a* than the cross-sectional area above. This causes the damper blade 15 to pivot in the pivot slot 15*d* on the cross beam section 13*a* around the pivot axis b—b so that the lower section 15*b* of the damper blade 15 pivots away from the distal end 11*c* of conduit 11 and the upper section 15*a* pivots into the conduit 11, towards the proximal end 11*b*. When gas flow through conduit 11 stops, gravity acts on the lower section 15*b* and causes the damper blade 15 to close against the lips 11*e* and 11*f* at the distal end 11*c* of the conduit 11 with the sealing tabs 15*e* and 15*f* sealing against the extension plate section 13*d* of the damper support beam 13 along the pivot axis b—b.

In a similar manner, in respect to the embodiment shown in FIGS. 5 to 9, with no gas flow through the conduit 31, the damper blade 35 closes off the distal end 31*d* of the conduit 31. When there is gas flow, however, more gas will flow below the cross beam section 33*a* because the cross-sectional area of the conduit 31 is greater below the cross beam section 33*a* than the cross-sectional area above. This causes the damper blade 35 to pivot on the pivot slot 35*d* on the cross beam section 33*a* around the pivot axis e—e so that the lower section 35*b* of the damper blade pivots away from the distal end 31*d* of the conduit 31 and the upper section 35*a* pivots into the conduit 31, towards the proximal end 31*c*. When gas flows through the conduit 31 ceases, gravity acts on the lower section 35*b* and causes the damper blade 35 to close against the lips 31*e* and 31*f* and the sealing tabs 31*g* and 31*h* of the conduit 31 and to rest against the stop tabs 33*i* of the damper support beam 33 with the sealing tab 35*d* sealing against the base portion 33*d* of the extension beam section 33*b* of the damper support beam 33 along the pivot axis e—e.

The embodiment of the present invention shown in FIGS. 5 to 9 is more sensitive to gas flow than the embodiment shown in FIGS. 1 to 4 because the moment of the damper blade 35 pivoting on the pivot axis e—e is greater than the moment of the damper blade 15 pivoting on the pivot axis b—b. As shown in FIG. 2, since the support beam 13 is only slightly offset above the longitudinal axis a—a of the conduit 11, almost the same cross-sectional area of the damper blade 15 is above the axis a—a as is below. Therefore, almost as much gas flow is causing a force on the upper section 15*a* of the damper blade 15 to force the upper section 15*a* closed as is moving against the lower section 15*b* of the damper blade 15 to force the damper blade 15 open. The result is that the damper blade 15 is held in a virtual state of equilibrium with an almost equal amount of gas causing a force to act to close the upper section 15*a* as is acting to force the bottom section 15*b* open. Therefore, the embodiment shown in FIG. 2 requires a sufficiently great quantity of gas flow through the conduit 11 to overcome the counter forces of the gas impinging on the upper section 15*a* and the gas impinging on the lower section 15*b* so that the force on the lower section 15*b* is great enough to overcome the force on the upper section 15*a* plus the weight differential between the lower section 15*b* and the upper section 15*a*, before the lower section 15*b* will pivot away from the distal end 11*c* of the conduit 11, causing the upper section 15*a* to pivot on the damper support beam 13, toward the proximal end 11*b* of the conduit 11.

As shown in FIGS. 7 to 9, the damper support beam 33 is mounted on the inner surface 31*b* of the conduit 31 approximately one half the distance between the longitudinal axis c—c of the conduit 31 and the upper apex 31*i* of the conduit 31. About 78% of the cross-sectional area of the damper blade 35 pivots away from the distal end 31*d* of the conduit 31, below the support plate beam 33. When there is gas flow through the conduit 31, almost 78% of the flow volume will impinge on the lower section 35*b* of the damper blade 35, below the support plate beam 33 while the rest of the flow volume will impinge on the upper section 35*a* of the damper blade 35. Therefore, more than three-quarters of the volume of gas flow through the conduit 31 will be acting to create a moment forcing the lower section 35*b* of the damper blade 35 to pivot away from the distal end 31*d* of the conduit 31. In comparison, only a little more than half the volume of gas flow through conduit 11 will act on the lower section 15*b* of the damper blade 15 to create a moment forcing the lower section 15*b* to pivot away from the distal end 11*c* of the conduit 11. This means that the damper blade 35 will react much more sensitively to lower gas flows through the conduit 31 than the damper blade 15 mounted in the conduit 11.

It is intended that the foregoing description be only illustrative of the present invention and that the present invention be limited only by the hereinafter appended claims.

I claim:

1. An air actuated damper device which comprises:

(a) a conduit means through which a gas is to be conveyed along a path in the conduit means around a longitudinal axis;

(b) a support means mounted across the conduit means with an extension portion of the support means extending along the path of the gas wherein the gas flows along the extension portion of the support means; and (c) a damper means pivotably mounted across the path of the conveyed gas on the support means, the damper means comprised of a spaced apart inside surface and an outside surface with a side between the surfaces, and the damper means having a slot provided by an interior opening formed by at least one inside wall defining the opening between the surfaces, wherein the extension portion of the support means extends through the slot with the damper means closed when gas is not conveyed in the conduit means and the damper means opens with the slot pivoting around the extension portion of the support means adjacent to where the support means is mounted across the conduit means when a gas is conveyed in the conduit means.

2. The damper device of claim 1 wherein the conduit means has a circular cross-section across the longitudinal axis and wherein the conduit means has at least one semicircular lip against which the damper means rests when gas is not conveyed in the conduit means.

3. The damper device of claim 2 wherein there are two semicircular lips at an outlet from the conduit means with the lips facing each other such that when the damper means is closed, a section of the damper means is outside of and on one of the lips and another section of the damper means is inside of and on the other of the lips.

4. The damper device of claim 1 wherein the support means is spaced from the longitudinal axis of the conduit means such that the damper means has two sections on opposite sides of the support means, one section of which is greater in cross-sectional area than the other section.

5. The damper device of claim 4 wherein the one section of the damper means is provided with a weight adjacent to the conduit means.

6. The damper device of claim 1 wherein the damper means has two sections on opposite sides of the support means and wherein the sections are spaced parallel to each other with a diagonal connection between the sections along a pivot axis on the support means and wherein the conduit means is provided with at least one lip adjacent to one of the sections such that the damper means rests on the lip when the damper means is closed when gas is not conveyed in the conduit means.

7. The damper device of claim 6 wherein the conduit means has a circular cross-section and the lip is semicircular.

8. The damper device of claim 7 wherein there are two semicircular lips at an outlet from the conduit means with the lips facing each other such that when the damper means is closed, a section of the damper means is outside of the on one of the lips and another section of the damper means is inside of and on the other of the lips.

9. The damper device of claim 1 wherein the support means is provided with an extension along the path of the conduit means and wherein a bar means is provided on the extension such that the slot in the damper means slides over the bar means and the damper means is positioned in the conduit means.

10. The damper device of claim 1 wherein the damper device is provided as an insert for a chimney carrying flue gases.

11. The damper device of claim 10 wherein the support means is provided with an extension along the path of the conduit means and wherein a bar means is provided on the extension such that the slot in the damper means slides over the bar means and the damper means is positioned in the conduit means.

12. The damper device of claim 11 wherein the conduit means has a circular cross-section and the lip is semicircular.

13. The damper device of claim 12 wherein the damper means has two sections on opposite sides of the support means and wherein the sections are spaced parallel to each other with a diagonal connection between the section along the pivot axis and wherein the conduit means is provided with at least one lip adjacent to one of the sections such that the damper means rests on the lip when the damper means is closed when gas is not conveyed in the conduit means.

14. The damper device of claim 13 wherein there are two semicircular lips at an outlet from the conduit means with the lips facing each other such that when the damper means is closed, a section of the damper means is outside of and on one of the lips and another section of the damper means is inside of and on the other of the lips.

15. The damper device of claim 13 wherein the support means is spaced from the longitudinal axis of the conduit means, such that the damper means has two sections on opposite sides of the support means, one section of which is wider across the conduit means than the other section.

16. The damper device of claim 15 wherein the one section of the damper means is provided with a weight adjacent to the conduit means.

17. The damper device of claim 15 wherein the support means is provided with an extension along the path of the conduit means and wherein a bar means is provided on the extension such that the slot in the damper means slides over the bar means and the damper means is positioned in the conduit means.

18. The damper device of claim 17 wherein sealing tab means are provided on opposite sides of the slot in the damper means which abut against the support means when damper means is closed.

19. The damper means of claim 16 wherein the sealing tab means are integral with the damper means.

20. The damper device of claim 1 wherein sealing tab means are provided on opposite sides of the slot in the damper means which abut against the support means when the damper means is closed.

21. The damper means of claim 20 wherein the sealing tab means are integral with the damper means.

22. The damper device of claim 1 wherein the damper means has a thin cross-section formed by spaced apart inner and outer sides with spaced apart rounded ends between the spaced apart sides and parallel lateral sides between the rounded ends, wherein the damper means forms two sections on opposite sides of a pivot axis and the support means with a first section comprised of the parallel lateral sides and one of the rounded ends and a second section comprised of the other rounded end and wherein the conduit means is provided with at least one lip adjacent to one of the section such that the damper means rests on the lip when the damper means is closed when gas is not conveyed in the conduit means.

23. The damper device of claim 22 wherein the conduit means has a circular cross-section and the lip is semicircular.

24. The damper device of claim 23 wherein there is an arcuate lip and a semicircular lip at an outlet from the conduit means with the lips facing each other such that when the damper means is closed, the first section of the damper means is outside of and on the semicircular lip and the second section of the damper means is inside of and on the arcuate lip.

25. The damper device of claim 24 wherein there are opposed enlarged lip sections at both ends of the semicircular lip that seal against the parallel lateral sides of the damper means when the damper means rests on the semicircular lip.

26. The damper device of claim 1 wherein the support means is provided with an extension along the path of the conduit means, the extension having a spaced apart upper surface and a lower surface forming a thin cross-section along the flow of the gas through the conduit and spaced apart sides between the spaced apart surfaces wherein one of the sides is parallel to the longitudinal axis of the conduit means and the other of the sides tapers downwardly and inwardly from the support means to the longitudinal axis of the conduit means and wherein a bar means having a spaced apart upper surface and a lower surface forming a thin cross-section in a plane similar to the plane of the thin cross-section of the extension is provided on the extension such that the slot in the damper means slides over the bar means and the damper means is positioned in the conduit means and pivotably mounted on the upper surface of the extension means and wherein the bar means has spaced apart first and second ends that form a wider cross-section across the flow of the gas through the conduit means than the extension of the support means with the first end adjacent to the parallel one of the sides of the extension and with the second end adjacent to the other of the sides of the extension and wherein before the damper means is slid over the bar means and positioned in the conduit means, the first and second spaced apart ends are in a plane similar to the plane of the extension and the support means and wherein after the damper means is slid over the bar means and is positioned in the conduit means, the first and second spaced apart ends of the bar means are positioned at about an angle of between 70 to 90 degrees to the plane of the extension and the support means so that the slot of the damper means is prevented from sliding off the bar means.

27. The damper device of claim 26 wherein the taper of the other of the sides of the extension of the support means is between about 45 and 85 degrees as measured from a line parallel to the longitudinal axis and extending from a junction of the other of the sides of the extension of the support means and the second spaced apart end of the bar means towards the support means.

* * * * *

UNITED STATES PATENT AND TRADEMARK OFFICE

CERTIFICATE OF CORRECTION

PATENT NO. : 5,090,445

DATED : February 25, 1992

INVENTOR(S) : Bert W. Jackson

It is certified that error appears in the above-identified patent and that said Letters Patent is hereby corrected as shown below:

Title page, Abstract, line 12, "11f, 31f)" should be --(11f, 31f)--.

Column 1, line 21, "recepticles" should be --receptacles--.

Column 4, line 40, before "35c", --pivot slot-- should be inserted.

Column 5, line 36, "flows" should be --flow--.

Column 7, line 28 (Claim 8), "outside of the" should read --outside of and--.

Column 8, line 12 (Claim 18), "device" should be --means--.

Column 8, line 18 (Claim 20), "device" should be --means--.

UNITED STATES PATENT AND TRADEMARK OFFICE

CERTIFICATE OF CORRECTION

PATENT NO. : 5,090,445

DATED : February 25, 1992

INVENTOR(S) : Bert W. Jackson

It is certified that error appears in the above-identified patent and that said Letters Patent is hereby corrected as shown below:

Column 8, line 34, claim 22, "section" should read --sections--.

Signed and Sealed this

Fourth Day of May, 1993

*Attest:*

Michael K. Kirk

MICHAEL K. KIRK

*Attesting Officer*

*Acting Commissioner of Patents and Trademarks*